US009278515B2

(12) United States Patent
Sarkisian et al.

(10) Patent No.: US 9,278,515 B2
(45) **Date of Patent: *Mar. 8, 2016**

(54) PRINTING METHOD

(75) Inventors: George Sarkisian, San Diego, CA (US); Ali Emamjomeh, San Diego, CA (US); Elizabeth Ann Visnyak, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 57 days.

This patent is subject to a terminal disclaimer.

(21) Appl. No.: 13/032,761

(22) Filed: Feb. 23, 2011

(65) Prior Publication Data

US 2011/0303113 A1 Dec. 15, 2011

Related U.S. Application Data

(63) Continuation-in-part of application No. PCT/US2010/038562, filed on Jun. 14, 2010.

(51) Int. Cl.

| | |
|---|---|
| ***B41M 5/00*** | (2006.01) |
| ***B41F 23/00*** | (2006.01) |
| ***B41J 2/21*** | (2006.01) |
| *B41M 7/00* | (2006.01) |

(52) U.S. Cl.

CPC ..... *B41F 23/00* (2013.01); *B41J 2/2114* (2013.01); *B41M 5/0017* (2013.01); *B41M 7/0036* (2013.01)

(58) Field of Classification Search

None

See application file for complete search history.

(56) References Cited

U.S. PATENT DOCUMENTS

| | | | | |
|---|---|---|---|---|
| 4,600,761 | A | 7/1986 | Ruffner et al. | |
| 5,635,970 | A | 6/1997 | Shirota et al. | |
| 5,965,257 | A | 10/1999 | Ahluwalia | |
| 6,123,760 | A | 9/2000 | Varnell | |
| 6,207,258 | B1 * | 3/2001 | Varnell | 428/32.1 |
| 6,740,689 | B1 | 5/2004 | Lee et al. | |
| 6,786,588 | B2 | 9/2004 | Koyano et al. | |
| 6,906,019 | B2 | 6/2005 | Nitzan et al. | |
| 7,105,260 | B2 | 9/2006 | Terauchi et al. | |
| 7,157,504 | B2 | 1/2007 | Ma et al. | |
| 7,354,476 | B2 | 4/2008 | Beach et al. | |
| 8,851,652 | B2 * | 10/2014 | Sarkisian et al. | 347/100 |
| 2002/0192381 | A1 | 12/2002 | Nitzan et al. | |
| 2003/0018101 | A1 | 1/2003 | Botros et al. | |
| 2003/0103129 | A1 | 6/2003 | Tanaka et al. | |
| 2004/0139566 | A1 * | 7/2004 | Szymanski | 8/518 |
| 2005/0274281 | A1 | 12/2005 | Jackson | |
| 2006/0203056 | A1 | 9/2006 | Furukawa et al. | |
| 2007/0056118 | A1 | 3/2007 | Ellis | |
| 2007/0067928 | A1 | 3/2007 | Ellis | |
| 2007/0216742 | A1 | 9/2007 | Sarkisian et al. | |
| 2007/0225401 | A1 | 9/2007 | Sarkisian et al. | |
| 2008/0081160 | A1 | 4/2008 | Anderle et al. | |
| 2008/0092309 | A1 | 4/2008 | Ellis et al. | |
| 2008/0108750 | A1 | 5/2008 | Terada et al. | |
| 2009/0219330 | A1 | 9/2009 | Kiyomoto et al. | |
| 2009/0233061 | A1 | 9/2009 | Irita | |
| 2009/0233068 | A1 | 9/2009 | Irita | |
| 2009/0234067 | A1 | 9/2009 | Kariya | |
| 2009/0295892 | A1 | 12/2009 | Akiyama et al. | |
| 2010/0075045 | A1 | 3/2010 | Kaimoto et al. | |
| 2010/0214352 | A1 | 8/2010 | Tsunoda et al. | |
| 2010/0231671 | A1 | 9/2010 | Anton et al. | |
| 2011/0113534 | A1 | 5/2011 | Sauer et al. | |
| 2012/0314000 | A1 | 12/2012 | Sarkisian et al. | |

FOREIGN PATENT DOCUMENTS

| | | | |
|---|---|---|---|
| CN | 101535424 | | 9/2009 |
| EP | 1391312 | | 2/2004 |
| JP | 2002079739 | | 3/2002 |
| JP | 2005074655 | | 3/2005 |
| JP | 2006159426 | | 6/2006 |
| JP | 2008266853 | | 11/2008 |
| JP | 2009149774 | | 7/2009 |
| JP | 2009299240 | A * | 12/2009 |
| JP | 2010046945 | | 3/2010 |
| JP | 2010069870 | | 4/2010 |
| JP | 2011168911 | | 9/2011 |
| WO | WO 99/06219 | | 2/1999 |
| WO | WO 2008/033569 | | 3/2008 |
| WO | WO 2008/052962 | | 5/2008 |
| WO | WO2009084600 | | 7/2009 |
| WO | WO 2009/143233 | | 11/2009 |

OTHER PUBLICATIONS

The Notification of the First Office Action for CN Application No. 201080066665.2 dated Oct. 22, 2013.

Supplementary European Search Report for S.N. PCT/US2010/038562 dated Aug. 6, 2013 (7 pages).

Supplementary European Search Report for S.N. PCT/US2011/025796 dated Aug. 6, 2013 (9 pages).

Supplementary European Search Report for S.N. PCT/US2011/025802 dated Sep. 2, 2013 (9 pages).

Air Products, "Performance Additives for Coatings, inks and Adhesives," Air Products, 7 pages, 2003.

Ashland (Flexbond 325 Technical Data Sheet. Ashland. 2009. 2 pages).

International Search Report and Written Opinion for PCT/US2011/025802 dated Nov. 30, 2011 (12 pages).

International Search Report and Written Opinion for PCT/US2011/025796 dated Nov. 30, 2011 (9 pages).

International Search Report and Written Opinion for PCT/US2010/038562 dated Mar. 31, 2011 (8 pages).

Luo (Microstructure Development in Particulate Composite Coatings by Cryo-SEM. Dissertation: Graduate School of the University of Minnesota, Sep. 2007, p. 101).

* cited by examiner

*Primary Examiner* — Joshua D Zimmerman

(74) *Attorney, Agent, or Firm* — Hewlett-Packard Patent Department

(57) ABSTRACT

A printing method for producing durable images is disclosed. Said method encompasses applying a pre-treatment composition, including a liquid vehicle and a polyvalent metal salt as fixing agent, onto a recording medium; applying an ink composition over said pre-treatment composition, said ink composition including an aqueous liquid vehicle and a colorant; and applying an over-print varnish composition.

24 Claims, No Drawings

PRINTING METHOD

CROSS-REFERENCE TO RELATED APPLICATIONS

This application is a continuation-in-part of International Application Serial No. PCT/US2010/038562, filed Jun. 14, 2010, which application is incorporated by reference herein in its entirety.

BACKGROUND

Inkjet technology has expanded its application to high-speed, commercial and industrial printing, in addition to home and office usage. Inkjet printing is a non-impact printing method in which an electronic signal controls and directs droplets or a stream of ink that can be deposited on a variety of substrates. Current inkjet printing technology involves forcing the ink drops through small nozzles by thermal ejection, piezoelectric pressure or oscillation, onto the surface of a media. This technology has thus become a popular way of recording images on various media surfaces, particularly paper, for a number of reasons, including, low printer noise, capability of high-speed recording and multi-color recording.

Though there has been great improvement in inkjet printing, improvements are followed by increased demands from consumers specifically regarding higher speeds, higher resolution increased stability, durability and ability to print on variety recording substrates. A recent trend is the ability to form images on numerous different media types. These different media types include envelopes, transparencies, card stock paper and any type of packaging substrates.

The ink composition is an important factor that helps to obtain good printing performances. However, in addition to ink composition, pre-treatment composition and/or post-treatment composition can be applied before and/or after an ink composition is established on the print recording medium in view of improving printing characteristics and attributes of the image. Such pre-treatment and/or post-treatment compositions are often substantially colorless liquids that might interact with some components of the ink composition and which result in the enhancement of image quality attributes, such as, for example, good optical density and durability.

DETAILED DESCRIPTION

Before particular embodiments of the present invention are disclosed and described, it is to be understood that the present disclosure is not limited to the process and materials disclosed herein. It is also to be understood that the terminology used herein is used for describing particular embodiments only and is not intended to be limiting, as the scope of the present invention will be defined only by the claims and equivalents thereof. In describing and claiming the present composition and method, the following terminology will be used: the singular forms "a", "an", and "the" include plural referents unless the context clearly dictates otherwise. Thus, for example, reference to "a pigment" includes reference to one or more of such materials. Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a weight range of approximately 1 wt % to about 20 wt % should be interpreted to include not only the explicitly recited concentration limits of 1 wt % to about 20 wt %, but also to include individual concentrations such as 2 wt %, 3 wt %, 4 wt %, and sub-ranges such as 5 wt % to 15 wt %, 10 wt % to 20 wt %, etc. Wt % means herein percentage by weight. All percents are by weight unless otherwise indicated. As used herein, "image" refers to marks, signs, symbols, figures, indications, and/or appearances deposited upon a material or substrate with either visible or an invisible ink composition. Examples of an image can include characters, words, numbers, alphanumeric symbols, punctuation, text, lines, underlines, highlights, and the like.

In some embodiments, the present disclosure refers to a printing method for producing durable images onto a recording medium. The method encompasses applying a pre-treatment composition onto a recording medium, said pre-treatment composition containing a liquid vehicle and a polyvalent metal salt as fixing agent; applying an ink composition over said pre-treatment composition, said ink composition comprising an aqueous liquid vehicle and a colorant, and then applying an over-print varnish composition. In some other embodiments, the pre-treatment composition, used herein, contains a liquid vehicle, a polyvalent metal salt as fixing agent, and a latex resin.

In some examples, the printing method for producing durable images includes depositing a pre-treatment composition on a recording medium, then jetting an aqueous ink composition that will react with the pre-treatment composition liquid. It is submitted that the pre-treatment composition, upon contact with ink, may cause the colorants present in the ink formulation to precipitate out and result in the enhancement of image quality attributes, as for example, optical density, chroma, and durability. Indeed, without being linked by any theory, it is believed that after the pre-treatment composition is overprinted with the ink composition on the substrate or, in other words, when ink and pre-treatment composition meet on the media surface, an effective immobilization of ink colorants is realized, and nearly all the colorants are deposited on the surface of the media rather than penetrating the media and depositing below the surface. The use of the pre-treatment composition such as disclosed herein results in the enhancement of image quality attributes while enabling variable and high-speed printing. Thus, in some examples, the ink composition overprints the pre-treatment composition. Such printing method results in printed media that have good durability performance. As durability performance, it is meant herein that the use of pre-treatment composition provides robustness to dry finishing as well as durability. In addition, the image forming method described herein produces printed images of high quality and enables high-speed printing.

In some embodiments, an over-print varnish composition is applied onto the printed image. In some examples, the printing method such as described herein is very well adapted for printing on specific recording medium such as packaging. Indeed, the use of an over-coating varnish composition provides an improved durability and gloss of the printed image, specifically when printed onto specific recording medium such as packaging. The over-print varnish composition is selected in view of providing adequate durability of the package printing. In some examples, according to the printing method described herein, the pretreatment fluid provides a control of bleed and coalescence with enough print durability to allow the print to make wet turns on the press and undergo finishing operations prior to the application of the over-print varnish composition.

In some examples, the printing method for producing durable images is an inkjet printing method. By inkjet printing method, it is meant herein a method wherein a stream of droplets of ink is jetted onto a recording substrate or medium to form the desired printed image. The ink composition may be established on the recording medium via any suitable inkjet printing technique. Examples of inkjet method include methods such as a charge control method which uses electrostatic attraction to eject ink, a drop-on-demand method which uses vibration pressure of a piezo element, an acoustic ink jet method in which an electric signal is transformed into an acoustic beam and ink is irradiated with the acoustic beam so as to be ejected by radiation pressure, and a thermal inkjet method which uses pressure caused by bubbles formed by heating ink. Non-limitative examples of such inkjet printing techniques include thus thermal, acoustic, and piezoelectric inkjet printing. In some examples, the ink composition is jetted onto the recording medium using an inkjet nozzle and/or an inkjet printhead. In some other examples, the ink composition is jetted onto the recording method using thermal inkjet printheads.

In some examples, the printing method for producing durable inkjet ink images is a high-speed printing method. By high speed, it is meant herein a method capable of printing more than 50 of feet per minute. In some examples, the web speed could be from about 50 to about 2 000 feet per minute. In some other examples, the printing method is a printing method capable of printing from about 50 to about 1 000 feet per minute. In yet some other examples, the printing method is a printing method capable of printing from about 50 to about 400 feet per minute.

The method encompasses applying a pre-treatment composition onto a recording medium, said pre-treatment composition containing a liquid vehicle and a polyvalent metal salt as fixing agent; applying an ink composition over said pre-treatment composition, wherein the time interval between the finishing point of the application of the pre-treatment composition on the recording medium and between the starting point of applying the ink composition is between 1 and 30 seconds; and then applying an over-print varnish composition. In some examples, the print delay time is between 5 and 30 seconds. By "print delay time", it is meant herein the time interval between the finishing point of the application of the pre-treatment composition on the recording medium and between the starting point of the application of the ink composition.

Without being linked by any theory, it is believed that the print delay time should be sufficient in view of allowing the proper mix of the pre-treatment composition and of the ink composition jetted on it, in view of obtaining a mix that solidifies slowly enough in view of providing a printed image with excellent durability performances. Such print delay time is often dependent on the web speed. For example, for web speeds of 100 fpm or less, the print delay time could be several seconds.

The time interval between the finishing point of printing (i.e. the finishing point of applying the ink composition) and the application of the over-print varnish composition vary depending on the printing method (inline or offline method). In some examples, the time interval between the finishing point of printing and the application of the over-print varnish composition this time interval vary from about 1 seconds to about 24 hours.

For inline printing method, the time interval between the finishing point of applying the ink composition and the application of the over-print varnish composition vary depending on the web or print conveyor speed. In some examples, this time interval is between 1 and 30 seconds. In some examples, with a high-speed web (400 fpm or over), the over-print varnish composition could be applied in less than 1 second. In some other examples, with a slow speed web (about 50 fpm) and long drying tunnel, the over-print varnish composition could be applied in more than 30 seconds. For offline printing method, the prints could be kept in rolls or stacked up to 24 hours before the application of the over-print varnish composition. Such over-print varnish composition would then be applied with a separate unit designed specifically for the application of said composition. In some examples, in offline overprinting method, the time interval between the finishing point of printing (i.e. the finishing point of applying the ink composition) and the application of the over-print varnish composition could vary from about 60 second to about 24 hours.

In some examples, the printing method for producing durable images onto a recording medium includes applying the pre-treatment composition, such as defined above, onto a recording medium using coater or coating devices and jetting an ink composition onto said recording medium via inkjet nozzles. The coater is not particularly limited and can be appropriately selected from known coaters according to the intended use. Examples of coater include an air doctor coater, a blade coater, a rod coater, a knife coater, a squeeze coater, an impregnation coater, a reverse roll coater, a transfer roll coater, a gravure coater, a kiss-roll coater, a cast coater, a slot die coater, a spray coater, a curtain coater, and an extrusion coater. Details of the method may be referenced in "Coating Kogaku (Coating Engineering)", by Yuji Harasaki. In some example, the coater is a transfer roll coating device. In order to apply the pre-treatment composition to the recording medium with a uniform thickness, an air-knife may be used for the coating or a member having an acute angle may be positioned with a gap corresponding to the predetermined amount of pre-treatment composition, between the member and the recording medium. The application of the pre-treatment composition may also be done by any known commercial methods such as gravure, inkjet method, spray coating method, and roller coating method. In some example, the pre-treatment composition is applied by a coating method using rollers. Thus, the pre-treatment composition may be rolled on recording medium using commercial roll coating equipment. Examples of printing method for producing durable inkjet ink images onto a recording medium includes thus applying the pre-treatment composition onto the recording medium with rollers or transfer roll coating devices. In some examples, a set of more than 3 rollers can be used. In some other examples, the printing method uses about up to 30 rollers. As an example, within such method, the pre-treatment composition is received onto a first surface, and then a contact is formed between the first surface and a transfer roll. The pre-treatment composition is then transferred from the first surface to the transfer roll. Finally, the pre-treatment composition is transferred from the transfer roller to a print medium. In one approach, the pre-treatment composition is applied to a print recording medium just before the printing of inks by printheads. According to this method, one or several rollers receive the pre-treatment composition and transfer it to a print medium. Thereafter, the print media receives inkjet ink from one or more inkjet printheads. In some examples, the pre-treatment composition is applied to a recording medium using coating devices and, subsequently, the ink is jetted by inkjet nozzles to record an image. Said inkjet ink composition includes an aqueous liquid vehicle and a colorant, wherein the inkjet ink overprint said pre-treatment composition. In some examples, the ink composition is applied to the recording medium using inkjet nozzles, and is applied after the application of the pre-treatment composition The printing method may further include a drying process in which the solvent (especially water) present in the ink composition is removed by drying. Thus, in some examples, as a further step, the recording medium is submitted to a hot air drying systems. Alternatively, or in combination with the drying process, a process may be provided in which the solvent in the ink is removed by absorbing the solvent by contacting a roller made of a porous material or the like with the surface of the recording medium.

The over-print varnish composition can be applied using coaters or coating devices. Examples of coater include an air doctor coater, a blade coater, a rod coater, a knife coater, a squeeze coater, an impregnation coater, a reverse roll coater, a transfer roll coater, a gravure coater, a kiss-roll coater, a cast coater, a slot die coater, a spray coater, a curtain coater, and an extrusion coater. The design of the over-print varnish composition coater can be very similar to the coater used in the application method of the pretreatment fluid. In some examples, a series of rollers could be used to transfer the fluid from a bath or from a fluid reservoir to the print. The print can be over-coated across the full width of the web to include more than the actual printed area. In some other examples, a slot die applicator is used in view of obtaining a curtain of over-print varnish fluid that is applied across the width of the print on the web.

In some embodiments, the pre-treatment composition and the over-print varnish composition are applied onto the recording medium using coating devices and the ink composition is jetted onto said recording medium via inkjet nozzles.

The pre-treatment composition is used as a fixing fluid composition in the printing method as described herein. The "pre-treatment composition" or "fixing fluid composition" contains an aqueous vehicle and an effective amount of one or more fixing agents. A fixing agent is an ingredient that initiates a change in the solubility or stability of the colorant and fixes the colorant in place in the printed image. An "effective amount" of fixing agents is an amount that is effective in achieving an improvement in print quality, e.g., decreased coalescence, strikethrough and bleed, increased optical density (OD), chroma, edge acuity, and good drip and smear fastness, as compared to a print that has not been fixed. The pre-treatment composition can be formulated for high spread and quick penetration and drying. The surface tension can be less than about 45 mN/m.

In some examples, the pre-treatment compositions, used in the printing method such as defined herein, have a viscosity within the range of about 1.0 to about 20,000 cps, and, in other examples, of about 10 to about 10,000 cps. Pre-treatment compositions might have a viscosity within the range of about 40 to about 5000 cps as measured at 25° C., in order to achieve the desired rheological characteristics. In some embodiments, the pre-treatment composition, for use in said printing method for producing durable images, contains a liquid vehicle, a polyvalent metal salt as fixing agent and a latex resin having a glass transition temperature (Tg) ranging from −22° C. to 20° C. In some examples, the pre-treatment composition includes latex resin components. The latex can be a cationic, an anionic or an amphoteric polymeric latex resin. The term latex refers herein to a group of preparations consisting of stable dispersions of polymeric micro-particles dispersed in an aqueous matrix. In some examples, the latex resin components are in the form of dispersed latex resin particles.

In some examples, the pre-treatment compositions include, as a fixing agent, a polyvalent metal salt. The polyvalent metal salt component can be a divalent or a higher polyvalent metallic ion and anion. In some examples, the polyvalent metal salt components are soluble in water. Examples of polyvalent metallic ions include divalent metallic ions, such as $Ca^{2+}$, $Cu^{2+}$, $Ni^{2+}$, $Mg^{2+}$, $Zn^{2+}$ and $Ba^{2+}$; trivalent metallic ions, such as $Al^{3+}$, $Fe^{3+}$ and $Cr^{3+}$. In some other examples, the polyvalent metallic ion is selected from the group consisting of $Ca^{2+}$, $Mg^{2+}$ or $Zn^{2+}$. In yet some other examples, the polyvalent metallic ions are $Ca^{2+}$. Examples of anions include $Cl^-$, $I^-$, $Br^-$, $NO_3^-$ or $RCOO^-$ (where R is H or any hydrocarbon chain). The polyvalent metal salt anion can be a chloride ($Cl^-$) or acetate ($CH_3COO^-$). In some examples, the polyvalent metal salt is composed of divalent or polyvalent metallic ions and of nitrate or carboxylate ions. The carboxylate ions are derived from a saturated aliphatic monocarboxylic acid having 1 to 6 carbon atoms or a carbocyclic monocarboxylic acid having 7 to 11 carbon atoms. Examples of saturated aliphatic monocarboxylic acid having 1 to 6 carbon atoms include formic acid, acetic acid, propionic acid, butyric acid, isobutyric acid, valeric acid, isovaleric acid, pivalic acid and hexanoic acid. In some examples, the fixing agent is a polyvalent metal salt selected from the group consisting of calcium chloride, calcium nitrate, magnesium nitrate, magnesium acetate or zinc acetate. In some other examples, the polyvalent metal salt is calcium chloride or calcium nitrate ($CaCl_2$ or $Ca(NO_3)_2$). In yet some other examples, the polyvalent metal salt is calcium chloride ($CaCl_2$).

The fixing agent can be present in the pre-treatment composition in an amount representing from about 1 to about 20 wt % of the total weight of the pre-treatment composition. In some other examples, the fixing agent is present in an amount representing from about 3 to about 15 wt % of the total weight of the pre-treatment composition. In yet some other examples, the fixing agent is present in an amount representing from about 7 to about 9 wt % based on the total weight of the pre-treatment composition.

In some examples, the pre-treatment composition can contain surfactants. Non-limiting examples of suitable surfactants include nonionic surfactant, cationic surfactant and combinations thereof. In some other examples, the surfactants are nonionic surfactants. In yet some other examples, the surfactants are nonionic surfactants selected from the group consisting of nonionic fluorosurfactant, nonionic acetylenic diol surfactant, nonionic ethoxylated alcohol surfactant and combinations thereof. In a non-limitative example, the pre-treatment composition contains nonionic ethoxylated alcohol surfactant. Several commercially available nonionic surfactants may be used in the formulation of the pre-treatment composition, examples of which include ethoxylated alcohols such as those from the Tergitol® series (e.g., Tergitol® 15S30, Tergitol® 15S9), manufactured by Dow Chemical; surfactants from the Surfynol® series (e.g. Surfynol® 440 and Surfynol® 465), manufactured by Air Products and Chemicals, Inc.; fluorinated surfactants, such as those from the Zonyl® family (e.g., Zonyl® FSO and Zonyl® FSN surfactants), manufactured by E.I. DuPont de Nemours and Company; fluorinated PolyFox® nonionic surfactants (e.g., PF159 nonionic surfactants), manufactured by Omnova; or combinations thereof. Suitable cationic surfactants that may be used in the pre-treatment composition include long chain amines and/or their salts, acrylated diamines, polyamines and/or their salts, quaternary ammonium salts, polyoxyethylenated long-chain amines, quaternized polyoxyethylenated long-chain amines, and/or combinations thereof. Surfactants can present in the pre-treatment composition in an amount up to about 1.5 weight percentage (wt %). As a non-limiting example, surfactants are present in an amount ranging from about 0.1 wt % to about 1 wt %. In still another non-limiting example, the surfactants are present in an amount ranging from about 0.2 wt % to about 0.6 wt %.

In some examples, the pre-treatment composition includes an aqueous vehicle. The term "aqueous vehicle," as defined herein, refers to the aqueous mix in which the fixing agent is placed to form the pre-treatment compositions. Examples of suitable aqueous vehicle components include, but are not limited to, water, co-solvents, surfactants, additives (corrosion inhibitors, salts, etc.), and/or combinations thereof. In some examples, the aqueous vehicle includes a water soluble organic co-solvent, a surfactant, and water. Non-limiting examples of the water soluble organic co-solvent include 2-ethyl-2-hydroxymethyl-1,3-propanediol, glycerol propoxylate, tripropylene glycol, 1-(2-hydroxyethyl)-2-pyrrolidinone, 1-(2-hydroxyethyl)-2-imidazolidinone, and/or combinations thereof. Other suitable solvents includes the amine-N-oxide and the acid include ethylene glycol, diethylene glycol, triethylene glycol, 1-propoxy-2-propanol (commercially available as Dowanol® PNP from The Dow Chemical Co., Midland, Mich.), and combinations thereof. In some examples, the organic co-solvent is present in the pre-treatment compositions composition in an amount up to about 25 wt %. In a non-limiting example, the organic co-solvent ranges from about 0 wt % to about 20 wt %. One or more additives may also be incorporated into any of the embodiments of the pre-treatment composition. As used herein, the term "additive" refers to a constituent of the fluid that operates to enhance performances, environmental effects, aesthetic effects, or other similar properties of the composition. Examples of suitable additives include biocides, sequestering agents, chelating agents, viscosity modifiers, anti-corrosion agents, marker dyes (e.g., visible, ultraviolet, infrared, fluorescent, etc.), dyes, optical whiteners, brighteners, and/or the like, and/or combinations thereof. In some examples, the additives are present in the pre-treatment composition in an amount ranging from about 0.01 wt % to about 1 wt %.

In some examples, the pre-treatment composition contains an anionic latex resin component having an Acid Number of less than 20. In some other examples, the latex resin has an Acid Number of less than 18. As used herein, the Acid Number (AN) refers to the acid number that has been measured by conductivity titration of the latent acid functions of the latex resin with nitric acid. The sample can be made strongly basic with KOH then is titrated with 1% of $HNO_3$. The pH and conductivity curves are measured simultaneously. In some examples, the latex resin components have a glass transition temperature (Tg) ranging from −22° C. to +20° C. The way of measuring the glass transition temperature (Tg) parameter is described in, for example, Polymer Handbook, 3rd Edition, authored by J. Brandrup, edited by E. H. Immergut, Wiley-Interscience, 1989. In some examples, the latex resin components, present in the pre-treatment composition have a glass transition temperature (Tg) ranging from −22° C. to +20° C. and have an acid number of less than 20. In some other examples, the latex resin components have a glass transition temperature (Tg) ranging from −3° C. to +7° C. and have an acid number of less than 20. Without being linked by any theory, it is believed that these Tg help to have a pre-treatment composition that provides adequate wet-on-wet mixing of the pretreatment fluid and of the ink by modulating the film forming rate of the resin/ink mixture.

The latex resin may be a resin made of polymer and copolymer selected from the group consisting of acrylic polymers or copolymers, vinyl acetate polymers or copolymers, polyester polymers or copolymers, vinylidene chloride polymers or copolymers, butadiene polymers or copolymers, styrene-butadiene polymers or copolymers, acrylonitrile-butadiene polymers or copolymers. In some other examples, the latex resin component is a latex containing particles of a vinyl acetate-based polymer, an acrylic polymer, a styrene polymer, an SBR-based polymer, a polyester-based polymer, a vinyl chloride-based polymer, or the like. In yet some other examples, the latex resin is a polymer or a copolymer selected from the group consisting of acrylic polymers, vinyl-acrylic copolymers and acrylic-polyurethane copolymers. The latex resin may have an average molecular weight (Mw) of 5,000 to 500,000. In some examples, the latex resins have an average molecular weight (Mw) ranging from 150,000 to 300,000. In some other embodiments, the latex resins have an average molecular weight of about 250,000. In some examples, the average particle diameter of the latex resin particles is from 10 nm to 1 μm; in some other examples, from 10 to 500 nm; and, in yet other examples, from 50 nm to 250 nm. The particle size distribution of the latex is not particularly limited, and either latex having a broad particle size distribution or latex having a mono-dispersed particle size distribution may be used. It is also possible to use two or more kinds of polymer fine particles each having a mono-dispersed particle size distribution in combination.

In some examples, the latex resin is present in the pre-treatment composition in an amount representing from about 1 to about 70 wt % of the total weight of the pre-treatment composition. In some other examples, the latex resin is present in an amount representing from about 10 to about 60 wt % of the total weight of the pre-treatment composition. In yet some other examples, the latex resin is present in an amount representing from about 20 to about 50 wt % of the total weight of the pre-treatment composition. The latex resin components may include, but is in no way limited to latex resin sold under the name Hycar® or Vycar® (from Lubrizol Advanced Materials Inc.); Rhoplex® (from Rohm & Haas company); Neocar® (from Dow Chemical Comp); Aquacer® (from BYK Inc) or Lucidene® (from Rohm & Haas company).

In some embodiments, the present disclosure refers to a printing method for producing durable images onto a recording medium that encompasses the step of applying an overprint varnish composition over a printed image. As overcoat varnish composition, it is meant herein a composition that will be applied over the printed image and that can form a transparent, protective film. The varnish compositions can encompass a resin and/or a solvent, and, most of the time, do not encompass colorants. Examples of overcoat varnish compositions include, but are not limited to, oil-based varnishes, aqueous varnishes, silicone water-based emulsions, waxes, and/or ultraviolet (UV) varnishes. In some embodiments, the overcoat varnish composition used in the printing method described herein is an aqueous overcoat varnish composition. Examples of ultraviolet varnishes include, but are not limited to, Nicoat®UVF 63Id (available from Nicoat), Wessco®3032 (available from Schmidt-rhyner), EXCure®90004 or EXCure®10705 (available from Arets), UltraSheen®9020 or Ultrasheen®9790 (available from Kelstar). Examples of water-based varnishes include, but are not limited to, overcoat varnish composition 060-7544-15.20EN and 060-7547-00.202EN (available from SICPA). Examples of waxes varnishes include, but are not limited to, ME 43040, ME 91240 and ME 98040M1 (available from Michelman). Examples of silicone water-based emulsions include, but are not limited to Web Protect®S18080 (available from Fuji Hunt). In some examples, overcoat varnish composition water-based varnish composition such as Nicoat®2710 (available from Nicoat).

In some examples, the overcoat varnish composition includes latex resin components. Such latex resin components are dispersed in water. In some examples, the overcoat varnish composition includes, as latex resin components, acrylics or styrene/acrylics polymers. The aqueous varnish composition might contain from about 40 wt % to about 50 wt % of latex resin solids (acrylics or styrene/acrylics) based on the total weight of the varnish composition. If the latex component is anionic latex, a latex salt can be made with sodium, potassium, and/or ammonium cations. In some examples, the overcoat varnish composition used herein is styrene/acrylate overcoat varnish composition. The varnish composition might further contain nonionic or anionic surfactants in an amount representing from about 0.1 to about 5 wt % of the composition. The varnish composition might also further contain a coalescent solvent in an amount representing up to about 10 wt %. In some examples, such coalescent solvent is Texanol® (available from Eastman Ltd.). In some examples, the overcoat varnish composition, when applied on the printed recording media has a coat weight in the range of about 2 to about 10 gram per $m^2$ (gsm); in some other examples, in the range of about 3 to about 8 gram per $m^2$ (gsm); and in yet some other examples, in the range of about 3 to 6 gsm.

In some examples, the recording medium is a recording material that is well adapted for inkjet printing device. Said recording medium may take the form of a sheet, a web, or a three-dimensional object of various shapes. In some examples, the recording medium can be a flexible film or a rigid substrate. As non-limiting examples, the recording medium may be selected from cellulosic or synthetic paper (coated or uncoated), cardboard, polymeric film (e.g. plastic sheet like PET, polycarbonate, polyethylene, polypropylene), fabric, cloth and other textiles. In some other examples, the bottom substrate layer may be single material plastic film made from PET, polyimide or other suitable polymer film with adequate mechanical properties. In some examples, the supporting substrate can be metal foils, rigid and/or flexible glasses. In some examples, the recording medium includes any substrate that is suitable for use in digital color imaging devices, such as electrophotographic and/or inkjet imaging devices, including, but in no way limiting to, resin coated papers (so-called photobase papers), papers, overhead projector plastics, coated papers, fabrics, art papers (e.g. water color paper), plastic film of any kind and the like. The substrate includes porous and non-porous surfaces. In some other examples, the recording medium is paper (non-limitative examples include plain copy paper or papers having recycled fibers therein) or photopaper (non-limitative examples include polyethylene or polypropylene extruded on one or both sides of paper) and/or combinations thereof.

In yet some other examples, the recording medium is a packaging. As packaging, it is meant herein any material used to pack or label something, for example a box, carton, bag, tag, label, can, or bottle to package a product. A label may be part of a continuous strip, sheet or web of a backing material upon which are disposed labels having adhesive on one side. A tag may be a portion of a continuous strip, sheet or web of material defined by a perforation or other area to be cut to create the tag. In some examples, the packaging may be substantially non-flat, such as bottles, cans, or other materials having substantial sizes in three dimensions. The packaging may enclose or substantially enclose a product and may have opaque, transparent, and/or translucent portions. In some examples, the packaging may be substantially flat, such as paper, cardboard, or plastic cards. In some other examples, the packaging may be substantially flat at one step in a process and become substantially non-flat at a second step in a process (e.g., where cardboard is formed into a box), and printing may occur at either step of the process. For example, a plastic packaging may be applied to a package of meat, whereby the packaging becomes substantially non-flat due to the non-flat surfaces of the meat, and printing is applied to the plastic in its non-flat form. In various examples including substantially flat or non-flat packaging, the packaging may be composed of paper, cardboard, plastic, metal, wood, glass, fabric or fibrous material, foam, rubber, another material, or any combination thereof.

In some examples, the ink composition used in the printing method for producing durable images onto a recording medium is an inkjet ink composition. In some other examples, the ink composition is an aqueous inkjet ink composition. Said ink composition includes an aqueous liquid vehicle and a colorant. In some examples, the colorant is selected from a yellow colorant, a magenta colorant, a cyan colorant and a black colorant, and the ink vehicle includes at least one solvent present in an amount ranging from about 1 to about 25 wt %; at least one surfactant present in an amount ranging from about 0.1 to about 8 wt %; at least one polymer present in an amount ranging from about 0 to about 6 wt %; at least one additive present in an amount up to about 0.2 wt %; and water. The colorant for each ink is selected from a pigment, a dye or combinations thereof. In some examples, the ink contains pigments as colorants. As used herein, "pigment" refers to a colorant particle that is substantially insoluble in the liquid vehicle in which it is used. Pigments can be dispersed using a separate dispersing agent, or can be self-dispersed, having a dispersing agent attached to the surface of the pigment. As used herein, "self-dispersed" generally refers to pigments that have been functionalized with a dispersing agent, such as by chemical attachment of the dispersing agent to the surface of the pigment. The dispersing agent can be a small molecule or a polymer or oligomer. The pigments include both self-dispersed pigments as well as dispersed pigments, e.g., pigments dispersed by a separate dispersing agent that is not covalently attached to the surface. In one example, the pigments are not self-dispersing, and a dispersing aid may be added to the vehicle. In another example, the pigments are self-dispersable and modified to include at least one polymer chemically attached thereto.

As alluded to, pigment colorant can be used in accordance with embodiments of the present disclosure. Specifically, if black is used, the black pigment can be any commercially available black pigment that provides acceptable optical density and print characteristics. Such black pigments can be manufactured by a variety of known methods such as channel methods, contact methods, furnace methods, acetylene methods, or thermal methods, and are commercially available from such vendors as Cabot Corporation, Columbian Chemicals Company, Evonik, Mitsubishi, and E.I. DuPont de Nemours and Company. In addition to black, other pigment colorants can be used, such as cyan, magenta, yellow, blue, orange, green, pink, etc. Suitable organic pigments include, for example, azo pigments including diazo pigments and monoazo pigments, polycyclic pigments (e.g., phthalocyanine pigments such as phthalocyanine blues and phthalocyanine greens, perylene pigments, perynone pigments, anthraquinone pigments, quinacridone pigments, dioxazine pigments, thioindigo pigments, isoindolinone pigments, pyranthrone pigments, and quinophthalone pigments), insoluble dye chelates (e.g., basic dye type chelates and acidic dye type chelate), nitropigments, nitroso pigments, anthanthrone pigments such as PR168, and the like. In some examples, the amount of colorants present in the ink compositions ranges from about 2.0 wt % to about 4.5 wt %. It is to be understood however, that the colorant loading may be more or less, as desired.

As defined herein, an "ink vehicle" refers to the vehicle in which the colorant is placed to form the ink. A wide variety of ink vehicles may be used with the inks and printing methods according to embodiments disclosed herein. Non-limiting examples of suitable components for the ink vehicle include water-soluble polymers, anionic polymers, surfactants, solvents, co-solvents, buffers, biocides, sequestering agents, viscosity modifiers, surface-active agents, chelating agents, resins, and/or water, and/or combinations thereof. Suitable solvents for the ink vehicle include, but are not limited to glycerol polyoxyethyl ether, tripropylene glycol, tetraethylene glycol, 1-(2-hydroxyethyl)-2-imidazolidinone, 1-(2-hydroxyethyl)-2-pyrrolidone, 1,6-hexanediol, 1,2,6-hexanetriol, trimethylolpropane, dipropylene glycol, Dantocol® DHE (Lonza Inc., Fairlawn N.J.), and/or combinations thereof. In a non-limiting example, the solvents are present in the ink vehicle in an amount ranging from about 1 wt % to about 25 wt %. In another non-limiting example, the solvents are present in the ink vehicle in an amount ranging from about 5 wt % to about 20 wt %.

In some embodiments, the ink composition includes water. In some examples, water is used as the ink carrier for the composition and is part of the liquid vehicle. In some other examples, the water makes up the balance of the ink composition, and may be present in an amount representing from about 40 to about 90 weight percentages or representing from about 50 to about 80 weight percentages by weight of the total composition.

The surfactants for the ink vehicle can be nonionic or anionic. Suitable nonionic surfactants include, but are not limited to ethoxylated alcohols, fluorinated surfactants, 2-diglycol surfactants, and/or combinations thereof. Specific examples of nonionic surfactants include surfactants from the Surfynol® series (e.g., Surfynol® CT211, Surfynol® SEF), manufactured by Air Products and Chemicals, Inc., in addition to the surfactants (e.g., Tergitol®) provided hereinabove for the aqueous vehicle of the fixer. Non-limiting examples of suitable anionic surfactants for the ink vehicle include those anionic surfactants of the Dowfax® family (e.g., Dowfax® 8390), manufactured by Dow Chemical Company, located in Midland, Mich., or anionic Zonyl® surfactants (e.g., Zonyl® FSA), manufactured by E.I. DuPont de Nemours and Company; phosphate ester surfactants including the surfactants of the Emphos® series and the DeDophoS® series, both manufactured by Witco Corp., Middlebury, the surfactants of the Crodafos® series, manufactured by Croda Inc., Edison, N.J., the surfactants of the Dephotrope® series and of the DePHOS® series, both manufactured by DeForest Enterprises Inc., Boca Raton, Fla.; alkyl sulfates (e.g., lauryl sulfate), alkyl ether sulfates (e.g., sodium laureth sulfate); N-lauroyl sarcosinate; dodecylbenzene sulfonate; and/or combinations thereof. In some examples, the ink vehicle includes one or more surfactants present in an amount up to about 8 wt %, with other non-limiting examples including from about 0.1 wt % to about 6 wt % and from about 1.2 wt % to about 2 wt %.

In some examples, the ink vehicle can include a polymer present in an amount ranging from about 0.01 wt % to about 4 wt % or in an amount ranging from about 0.1 wt % to about 1.5 wt %. The polymers for the ink vehicle are generally water-soluble, and may be selected from those of the salts of styrene-(meth)acrylic acid copolymers, polystyrene-acrylic polymers, polyurethanes, and/or other water-soluble polymeric binders, and/or combinations thereof. As a non-limiting example, one class of polymeric binders suitable for use in the ink includes salts of styrene-(meth)acrylic acid copolymers. Suitable non-limiting examples of styrene-(meth) acrylic acid copolymers are commercially available and may be selected from the Joncryl® series (e.g., Joncryl® 586 and 683), manufactured by BASF Corp. located in Florham Park, N.J.; SMA-1000Na and SMA-1440K, manufactured by Sartomer, located in Exton, Pa.; Disperbyk 190, manufactured by BYK Chemicals, located in Wallingford, Conn.; polystyrene-acrylic polymers manufactured by Gifu Shellac, located in Japan; or combinations thereof. Additives may also be incorporated into embodiments of the ink vehicle for the inks. As a non-limiting example, bactericides, such as Proxel® GXL, may be added to the ink to protect the ink from bacterial growth. Other suitable additives include, but are not limited to, buffers, biocides, sequestering agents, chelating agents, or the like, or combinations thereof. In some examples, the ink vehicle includes one or more additives present in an amount ranging from about 0.1 wt % to about 0.5 wt %. In other examples, no additives are present.

In some examples, the printing method includes the use of the pre-treatment composition, of a varnish composition and the use of at least an inkjet ink composition selected from a black ink, a yellow ink, a cyan ink, a magenta ink, an orange ink, a red ink, and a green ink. In some other examples, at least one ink is deposited into individual printheads. Non-limiting examples of suitable printhead configurations include single printheads, dual chamber printheads, tri-chamber printheads and/or the like, and/or combinations thereof. It is to be understood that any number of colored ink compositions may be used in the method such as described herein. Furthermore, any desirable combination of colored inks may be used. For example, each of the colored ink compositions may be of a different color, or two or more of the inks may be different shades of the same color (i.e., light magenta and dark magenta inks). In some examples, four different colored inks can be used: a black ink, a yellow ink, a cyan ink, and a magenta ink. As an example, the pre-treatment composition, the varnish composition and the ink composition are part of a printing system for printing durable inkjet images. Said printing system includes pre-treatment composition and varnish composition applicators, and contains one or several successive inkjet printheads containing inkjet ink composition. In an example, the inkjet printheads are thermal inkjet printheads. The ink printing system presents excellent printing performances and image characteristics.

EXAMPLES

Ingredients and Abbreviations

Lucidene 645® is an acrylic urethane polymer available from Rohm & Haas.

LEG-1 is a co-solvent available from Liponics.

Zonyl® FSO is a surfactant available from Dupont. Inc.

Cab-O-Jet® 300 is a self dispersed pigment available from Cabot Corporation

Joncryl® 586 is a styrene-acrylic binder available from BASF Corp.

Proxel® GXL is a biocide available from Arch Chemicals Inc.

Chemguard S-550® is a fluorosurfactant available from Chemguard.

Byk-018® is a defoamer available from Byk Co.

Tergitol® 15s30 is a surfactant available from Talas Inc.

PolyFox® PF 159 is a fluorosurfactant available from Omnova Solution Inc.

Example 1

Preparation of Ink Composition

A black inkjet ink composition is prepared in accordance with TABLE 1 below. All percentages are expressed in percentage by weight (wt %) based on the total weight of the ink composition.

TABLE 1

| Component | Amount (wt %) |
|---|---|
| BP 700 Black Pigment | 3.0 |
| Cab-O-Jet ® 300 | 1.0 |
| Joncryl ® 586 | 1.0 |
| 2-Pyrrolidone | 10.0 |
| LEG-1 | 1.0 |
| Zonyl ® FSO | 0.1 |
| Proxel ® GXL | 0.1 |
| Water | Balance |

Example 2

Preparation of Pre-Treatment Compositions

Pre-treatment compositions A and B are prepared in accordance with TABLE 2. All percentages are expressed in percentage by weight (wt %) based on the total weight of the pre-treatment composition.

TABLE 2

| Pre-treatment compositions | A | B |
|---|---|---|
| Lucidene ® 645 | — | 33.00 |
| Byk-018 ® | — | 0.50 |
| 2-Pyrrolidone | — | 3.00 |
| Calcium Chloride | 15.00 | 7.00 |
| Chemguard ® S550L | — | 0.10 |
| PolyFox ® PF159 | 0.20 | — |
| Tergitol ® 15s30 | 0.20 | — |
| Water | Up to 100% | Up to 100% |

Example 3

Printing Method Performances

Pre-treatment compositions A and B are rolled on with an industrial coating fixture on media using a forward roll coating. An identical image sequence is then printed with black ink having formulation such as illustrated in Example 1, using a HP T-200 web-press. The coat weight for the roll-on pre-treatment is 2 grams/sq meters. 10 grams/sq meter of black ink is then printed on top of each pre-treatment formulation. The web speed for the printing process is 400 fpm; the print delay time is 1 seconds. The media used is a glossy coated media (Sterling Ultra Gloss Text—80# Ultra Gloss).

An aqueous overprint varnish composition (Nicoat®2710, available from Nicoat Inc.) is over-coated using a blade coater at 8 grams/sq meters. Half of the prints are over-coated with the overprint varnish composition. The other set of prints are not over-coated. Durability tests (Resistance tests) are performed onto the printed media under conditions that simulated outdoor weathering and abrasion. The "rub resistance" refers to the ability of a printed image to resist appearance degradation upon rubbing the image. Good rub resistance, upon rubbing, will tend not to transfer ink from a printed image to surrounding areas where the ink has not been printed and the black optical density (KOD) will be maintained.

"Taber Wet Rub" tests are performed with Taber Linear Abrader with a plastic rubbing tip wrapped with a wet cloth. The water rub test is used with a water wet cloth and the Windex® rub test uses. Windex® to wet the cloth (Windex®, from SC Johnson, is a glass cleaner containing about 40 wt % of isopropyl alcohol in water, a blue coloring dye and less than about 1 wt % of surfactants). For both tests, a 2 inch linear stroke is made across the print with the cloth wrapped tip set a 350 g pressure. Five stroke cycles are used.

"Taber Dry Rub" tests are performed. The "Taber Eraser dry rub" is done 10 times during 2 seconds cycles with 600 g weight. The "Taber Steel dry rub" is done 10 times during 2 seconds cycles with 850 g weight. The cycles are made with the eraser in the black area fill print. The KOD is measured before and after the rub. The Taber process shows more handling and abrasion effects on the sample.

"Sutherland Dry Rub" tests are performed with a Sutherland Rub Testor that cycles a 4 lb weight across the print. The test simulates shipping a stack of prints or printed packages that may undergo damage due to vibration of one print against another during handling or transportation. A 2×3 inch cut of the print is placed on a platen, and an unprinted cut of the same media is taped to the bottom of the rectangular 4 lb metal block. The block is rubbed in an arc across the print for 10 cycles.

For each print, before and after the test, the black optical density (KOD) and the gloss are measured. The black optical density (KOD) is measured using an X-Rite densitometer to measure the reflectance of the area filled. The higher the KOD value, the darker the black colored image obtained. Black optical density changes of the print media samples are then evaluated (ΔKOD). The numbers herein refer to the difference in optical density (ΔKOD) that has been measured (The smaller the number is, the better the performance is).

The surface gloss of each media sample is measured using a Micro Tri-Gloss Meter (available from BYK Gardner Inc) according to the standard procedures described in the instrument manual provided by the manufacturer. The Micro-Tri Gloss Meter is calibrated at sixty)(60° degrees using the standard supplied by the unit. Measurements are made on three sample sheets, and the average value is reported in terms of gloss units (GU). The numbers herein refer to the difference in optical density (ΔGloss) that has been measured.

TABLE 3a

| Pre-treatment compositions | Post-treatment with varnish composition | KODΔ Taber Wet Rub | | 60°Gloss Δ Taber Wet Rub | |
|---|---|---|---|---|---|
| | | Water | Windex ® | Water | Windex ® |
| A | yes | 0.66 | 0.36 | 38.8 | 24.1 |
| A | no | 1.38 | 1.37 | Print rubbed off | Print rubbed off |
| B | yes | 0.25 | 0.39 | 42.5 | 29.6 |
| B | no | 0.95 | 1.12 | Print rubbed off | Print rubbed off |

TABLE 3b

| Pre-treatment compositions | Post-treatment with varnish composition | KOD | KODΔ Taber DRY Rub Eraser | KODΔ Taber DRY Rub Steel | 60° Gloss Δ Taber DRY Eraser | 60° Gloss Δ Taber DRY Steel |
|---|---|---|---|---|---|---|
| A | yes | 2.26 | 0.28 | 0.11 | 34.30 | 1.1 |
| A | no | 1.57 | 1.19 | 0.96 | Print rubbed off | Print rubbed off |
| B | yes | 2.51 | 0.57 | −0.04 | 32.20 | −1.90 |
| B | no | 1.78 | 1.08 | −0.01 | Print rubbed off | −8.5 |

TABLE 3c

| Pre-treatment compositions | Post-treatment with varnish composition | Sutherland Rub Tests KODΔ | Sutherland Rub Tests OD transfer | 60° Gloss Media | 60° Gloss Print |
|---|---|---|---|---|---|
| A | yes | 0.00 | −0.02 | 76.2 | 79.8 |
| A | no | 0.84 | 0.10 | 30.4 | 16.7 |
| B | yes | 0.00 | 0.00 | 83.9 | 67.1 |
| B | no | 0.26 | 0.03 | 54.7 | 30.2 |

These results, illustrated in TABLE 3a, 3b and 3c, demonstrate that the printed image, obtained with the application of the pre-treatment composition, when treated with an overcoat Varnish composition presents good resistance to wet rub and barely noticeable change in KOD or 60° gloss. When the Varnish composition is not present, poor results are obtained: the print is wiped off. When the pretreatment composition contains resins, the performances are even better.

The preceding description has been presented only to illustrate and describe embodiments of the present invention. Although certain methods and compositions have been described herein, the scope of coverage of this patent is not limited thereto. On the contrary, this patent covers all methods and compositions fairly falling within the scope of the claims either literally or under the doctrine of equivalents.

The invention claimed is:

1. A printing method for producing durable images, comprising:

a. applying a pre-treatment composition onto a recording medium selected from the group consisting of a coated or uncoated cellulosic paper, a coated or uncoated synthetic paper, a cardboard, and a polymeric film, said pre-treatment composition comprising:

a liquid vehicle;

an anionic latex resin selected from the group consisting of vinyl-acrylic copolymers, acrylic-polyurethane copolymers, vinyl acetate polymers or copolymers, polyester polymers or copolymers, vinylidene chloride polymers or copolymers, butadiene polymers or copolymers, styrene-butadiene polymers or copolymers, and acrylonitrile-butadiene polymers or copolymers, the latex resin being present in an amount ranging from about 20 wt % to about 50 wt % of a total weight of the pre-treatment composition; and a polyvalent metal salt as a fixing agent;

b. applying an ink composition over said pre-treatment composition, said ink composition comprising an aqueous liquid vehicle and a colorant, wherein the ink composition is applied over the pre-treatment composition while the pre-treatment composition is still wet on the recording medium; and c. applying an over-print varnish composition on the ink composition.

2. The printing method of claim 1 wherein the latex resin has a glass transition temperature ranging from −22° C. to 20° C.

3. The printing method of claim 1 wherein the latex resin has a glass transition temperature ranging from −3° C. to +7° C.

4. The printing method of claim 1 wherein the latex resin has an acid number of less than 20.

5. The printing method of claim 1 wherein the fixing agent is selected from the group consisting of calcium chloride, calcium nitrate, magnesium nitrate, magnesium acetate, and zinc acetate.

6. The printing method of claim 1 wherein the fixing agent is calcium chloride or calcium nitrate.

7. The printing method of claim 1 wherein the fixing agent is present in an amount representing from about 1 wt % to about 20 wt % of the total weight of the pre-treatment composition.

8. The printing method of claim 1 wherein the pre-treatment composition further comprises up to about 1.5 wt % of surfactants.

9. The printing method of claim 1 wherein the over-print varnish composition is an aqueous overcoat varnish composition.

10. The printing method of claim 1 wherein the over-print varnish composition is a styrene/acrylate overcoat varnish composition.

11. The printing method of claim 1 wherein a time interval between a finishing point of the application of the pre-treatment composition on the recording medium and a starting point of the application of the ink composition ranges between 1 second and 30 seconds.

12. The printing method of claim 1 wherein a print speed of the printing method ranges between about 50 fpm and about 400 fpm.

13. The printing method of claim 1 wherein the pre-treatment composition and the over-print varnish composition are applied onto the recording medium using coating devices and wherein the ink composition is jetted onto the recording medium via inkjet nozzles.

14. The printing method of claim 1 wherein the applying of the pre-treatment composition includes applying the pre-treatment composition at a coat weight of 2 grams/sq meter (gsm).

15. The printing method of claim 1 wherein the latex resin is present in an amount ranging from about 33 wt % to about 50 wt % of the total weight of the pre-treatment composition.

16. A printing method for producing durable images, comprising:

a. applying a pre-treatment composition onto a recording medium, said pre-treatment composition including:

a liquid vehicle;

an anionic latex resin selected from the group consisting of vinyl-acrylic copolymers, vinylidene chloride polymers or copolymers, butadiene polymers or copolymers, and acrylonitrile-butadiene polymers or copolymers, the latex resin being present in an amount ranging from about 10 wt % to about 50 wt % of a total weight of the pre-treatment composition; and a polyvalent metal salt as a fixing agent;

b. applying an ink composition over said pre-treatment composition, said ink composition comprising an aqueous liquid vehicle and a colorant, wherein the ink composition is applied over the pre-treatment composition while the pre-treatment composition is still wet on the recording medium; and c. applying an over-print varnish composition on the ink composition.

17. The printing method of claim 16 wherein the recording medium is selected from the group consisting of a coated or uncoated cellulosic paper, a coated or uncoated synthetic paper, a cardboard, and a polymeric film.

18. The printing method of claim 1 wherein the latex resin comprises acrylic-polyurethane copolymers.

19. The printing method of claim 1 wherein a time interval between a finishing point of the application of the ink composition over the pre-treatment composition and a starting point of the application of the over-print varnish composition ranges between 1 second and 30 seconds.

20. The printing method of claim 1 wherein a time interval between a finishing point of the application of the ink composition over the pre-treatment composition and a starting point of the application of the over-print varnish composition is about 1 second.

21. A printing method for producing durable images, comprising:

applying a pre-treatment composition onto a recording medium, said pre-treatment composition including:

a liquid vehicle;

an anionic latex resin selected from the group consisting of vinyl-acrylic copolymers, acrylic-polyurethane copolymers, vinyl acetate polymers or copolymers, polyester polymers or copolymers, vinylidene chloride polymers or copolymers, butadiene polymers or copolymers, styrene-butadiene polymers or copolymers, and acrylonitrile-butadiene polymers or copolymers, the latex resin being present in an amount ranging from about 10 wt % to about 50 wt % of a total weight of the pre-treatment composition; and a polyvalent metal salt as a fixing agent;

applying an ink composition over said pre-treatment composition, said ink composition comprising an aqueous liquid vehicle and a colorant, wherein the ink composition is applied over the pre-treatment composition while the pre-treatment composition is still wet on the recording medium; and applying an over-print varnish composition on the ink composition.

22. The printing method of claim 21 wherein the latex resin is present in an amount ranging from about 10 wt % to about 33 wt % of the total weight of the pre-treatment composition.

23. The printing method of claim 21 wherein the latex resin comprises acrylic-polyurethane copolymers.

24. The printing method of claim 21 wherein the anionic latex resin has a glass transition temperature ranging from −22° C. to 20° C., and has an acid number of less than 20.

* * * * *